US006820530B2

(12) United States Patent
Vais

(10) Patent No.: US 6,820,530 B2
(45) Date of Patent: Nov. 23, 2004

(54) EXTENDED CHAMBER MUZZLE BRAKE

(76) Inventor: George M. Vais, 182 S. Cole Rd., Boise, ID (US) 83709

( * ) Notice: Subject to any disclaimer, the term of this patent is extended or adjusted under 35 U.S.C. 154(b) by 0 days.

(21) Appl. No.: 10/163,191

(22) Filed: Jun. 4, 2002

(65) Prior Publication Data

US 2003/0106417 A1 Jun. 12, 2003

Related U.S. Application Data

(63) Continuation-in-part of application No. 10/004,999, filed on Dec. 7, 2001, now Pat. No. 6,752,062.

(51) Int. Cl.[7] ..... F41A 21/32
(52) U.S. Cl. ..... 89/14.3
(58) Field of Search ..... 89/14.2, 14.3, 89/14.4; D22/108

(56) References Cited

U.S. PATENT DOCUMENTS

| | | | | | |
|---|---|---|---|---|---|
| 1,427,802 | A | | 9/1922 | Goodwin | |
| 2,112,831 | A | | 4/1938 | Cutts, Jr. | 89/14 |
| 2,322,370 | A | * | 6/1943 | Lance | 89/14.3 |
| 2,662,326 | A | | 12/1953 | Powell | 42/79 |
| 2,796,005 | A | * | 6/1957 | Shapel | 89/14.3 |
| 3,367,055 | A | | 2/1968 | Powell | 42/79 |
| 3,707,899 | A | | 1/1973 | Perrine | 89/14 C |
| D279,812 | S | * | 7/1985 | Cellini | D22/108 |
| D280,655 | S | * | 9/1985 | Cellini | D22/108 |
| 4,570,529 | A | * | 2/1986 | A'Costa | 89/14.2 |
| D285,237 | S | * | 8/1986 | Cellini | D22/108 |
| D285,238 | S | * | 8/1986 | Cellini | D22/108 |
| D285,331 | S | * | 8/1986 | Cellini | D22/108 |
| 4,691,614 | A | * | 9/1987 | Leffel et al. | 89/14.3 |
| D296,350 | S | * | 6/1988 | Cellini | D22/108 |
| 4,945,812 | A | * | 8/1990 | Mazzanti | 89/14.3 |
| 4,967,642 | A | * | 11/1990 | Mihaita | 89/126 |
| 5,155,291 | A | * | 10/1992 | Dabrowski | 89/14.05 |
| 5,305,677 | A | * | 4/1994 | Kleinguenther et al. | 89/14.2 |
| 5,367,940 | A | * | 11/1994 | Taylor | 89/14.3 |
| 5,476,028 | A | * | 12/1995 | Seberger | 89/14.3 |
| 5,612,504 | A | | 3/1997 | Stitt et al. | 89/14.3 |
| D384,389 | S | * | 9/1997 | Cyktich | D22/108 |
| 5,811,714 | A | * | 9/1998 | Hull et al. | 89/14.3 |
| 5,814,757 | A | * | 9/1998 | Buss | 89/14.3 |
| 6,425,310 | B1 | * | 7/2002 | Champion | 89/14.3 |

* cited by examiner

*Primary Examiner*—Jack Keith
*Assistant Examiner*—Troy Chambers
(74) *Attorney, Agent, or Firm*—Derek H. Maughan; Dykas, Shaver & Nipper

(57) ABSTRACT

A muzzle brake having an elongated inner chamber for dissipating a recoil force created by the discharge of a firearm having a muzzle, without a substantially increasing the noise heard by the shooter. The muzzle brake is a cylinder with an inner chamber and at least one opening radially disposed from a central bore. The inner chamber reflects gas and sound energy, which is then directed toward the openings. These openings have a longitudinal dimension greater than a lateral dimension and help to dissipate force-causing gases away from the muzzle end of a firearm with reduced reflection of gases back towards the shooter. The decreased amount gas reflected back toward the shooter decreases the amount of noise the shooter hears.

9 Claims, 6 Drawing Sheets

EXTENDED CHAMBER MUZZLE BRAKE

REFERENCES TO RELATED APPLICATION

This application is a continuation-in-part of application Ser. No. 10/004,999 filed on Dec. 7, 2001 now U.S. Pat. No. 6,752,062, entitled Muzzle Brake. The contents of which are hereby incorporated herein by reference.

BACKGROUND OF THE INVENTION

1. Field of the Invention

The present invention generally relates to a muzzle brake for firearms and more particularly to a muzzle brake for firearms that decreases the amount of noise perceived by a shooter of the firearm.

2. Background Information

When a high-powered rifle is fired, the gas that propels the projectile out of the end of the firearm rapidly expands upon discharge from the firearm. This rapid expansion of gases produces a recoil, which is forced back towards the shooter. This recoil force can be quite severe, especially in high-powered rifles, and may result in pain, discomfort, and fatigue to the shooter. To reduce these side effects, "muzzle brakes" are used to lessen this recoil force.

Most muzzle brakes comprise an attachment placed on the muzzle end of a firearm to reduce recoil by redirecting and dissipating propellant gases radially away from the direction of the barrel of the firearm through a series of openings within the attachment. This dispersion of the propellant gases diffuses the amount of gas that rapidly expands and lessens the recoil force felt by the shooter. However, in deflecting gas away from the end of the barrel, some of the gas impinges upon the surfaces of the muzzle brake itself and are reflected back towards the shooter. This increased reflection of gases increases the amount of sound energy directed towards the shooter, and results in the shooter perceiving more noise from a gun equipped with a muzzle brake than from the same gun without the muzzle brake. For this reason, firearms equipped with conventional muzzle brakes often sound much louder to the shooter than the same firearm without a muzzle brake. Hence, one must choose between either increased recoil force or increased noise in order to operate the firearm. Therefore, what is needed is a muzzle brake that functions to reduce the recoil force felt by the shooter without a substantial increase in noise perceived by the shooter.

Accordingly, it is an object of the invention to reduce the recoil force felt by a shooter upon discharge of a firearm in a manner that is significantly quieter than existing muzzle brakes.

Additional objects, advantages, and novel features of the invention will be set forth in part in the description as follows, and in part will become apparent to those skilled in the art upon examination of the following, or may be learned by practice of the invention. The objects and advantages of the invention may be realized and attained by means of the instrumentalities and combinations particularly pointed out in the appended claims.

SUMMARY OF THE INVENTION

The present invention is a muzzle brake device for reducing recoil while limiting noise perceived by a shooter upon the discharge of a firearm having a muzzle. This muzzle brake is made up of a cylindrically shaped body having a first end adapted for attachment to the muzzle of the gun. The muzzle brake body has an outer surface extending from the first end to a second end along a generally longitudinal axis. At least one opening, having a longitudinal dimension greater than a lateral dimension, extends from the outer surface to a central bore. This central bore is located in a generally central portion of the body and extends through the body along a longitudinal axis. These openings allow gases and sounds to be dissipated away from the central bore. The increased longitudinal component of the openings facilitates the dispersion of gases away from the central bore and reduces the amount of noise that would be perceived by the shooter. In addition to the elongated openings, noise is further reduced by the presence of an internal chamber within the body. This internal chamber is located about the central bore in a location generally between the first end and a first opening. This internal chamber has a diameter generally greater than the diameter of the central bore and allows for partial expansion of the gases as they pass through the chamber and are directed by reflection towards the openings. In a preferred embodiment, the end of the chamber near the openings has a tapered frustoconically shaped second edge that further facilitates passage of the gas out of the device through the openings, without reflection.

In use, the invented muzzle brake is attached to the end of a muzzle of a firearm. When the firearm is discharged, the projectile passes out of the muzzle of the firearm and through the bore of the invented muzzle brake. As the projectile passes through the muzzle brake, the gases partially expand in the inner chamber and are reflected off of the walls of the inner chamber toward the openings in the muzzle brake. The elongated dimension of the openings facilitates the dispersion of the gases away from the muzzle brake and decreases the amount of gas that impacts against the outer surface. This reduction in impact against the outer surface reduces the amount of noise perceived by the shooter when using this muzzle brake as compared to other muzzle brakes.

Still other objects and advantages of the present invention will become readily apparent to those skilled in this art from the following detailed description wherein I have shown and described only the preferred embodiment of the invention, simply by way of illustration of the best mode contemplated by carrying out my invention. As will be realized, the invention is capable of modification in various obvious respects all without departing from the invention. Accordingly, the drawings and description of the preferred embodiment are to be regarded as illustrative in nature, and not as restrictive.

DESCRIPTION OF THE PREFERRED EMBODIMENTS

Figure 1:
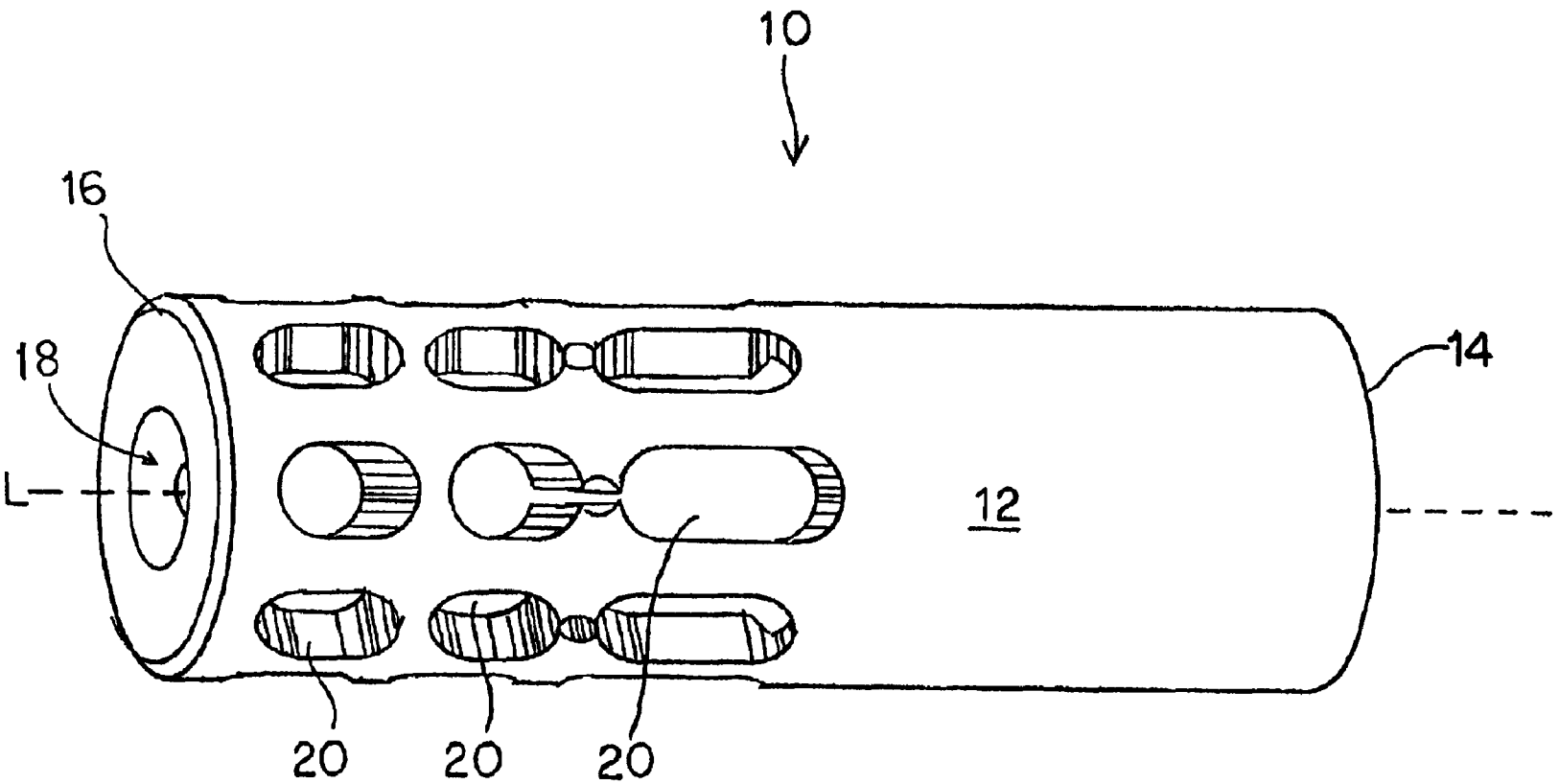
FIG. 1 is a perspective view of a first embodiment of the present invention.

While the invention is susceptible of various modifications and alternative constructions, certain illustrated embodiments thereof have been shown in the drawings and will be described below in detail. It should be understood, however, that there is no intention to limit the invention to the specific form disclosed, but, on the contrary, the invention is to cover all modifications, alternative constructions, and equivalents falling within the spirit and scope of the invention as defined in the claims.

The present invention is a muzzle brake for reducing recoil without a significant increase in noise perceived by the shooter upon discharge of a firearm. FIGS. 1 through 6 show two different embodiments of the present invention, including the various features herein described.

Figure 2:
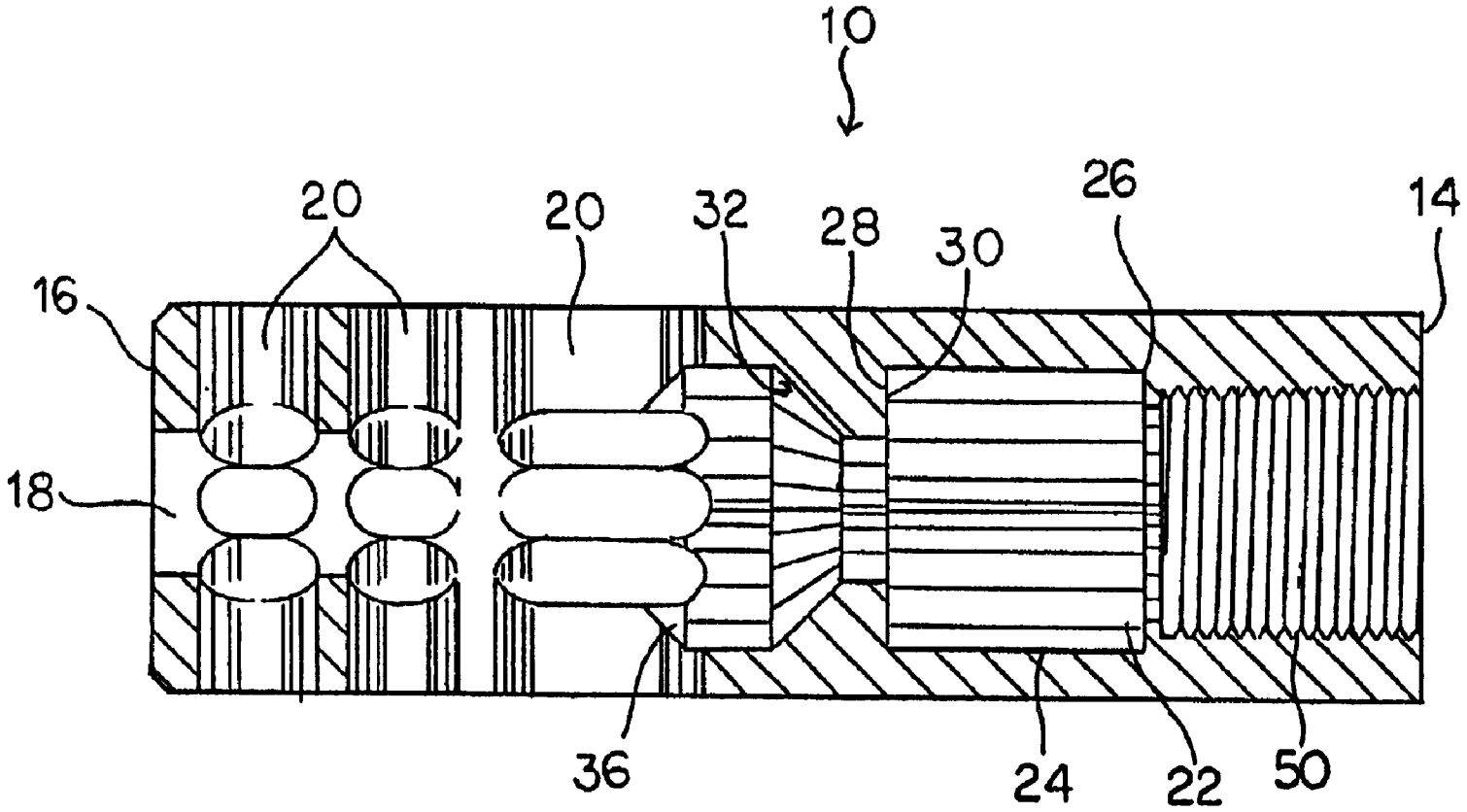
FIG. 2 is cross-sectional side view of a first embodiment of the present invention.
Figure 3:
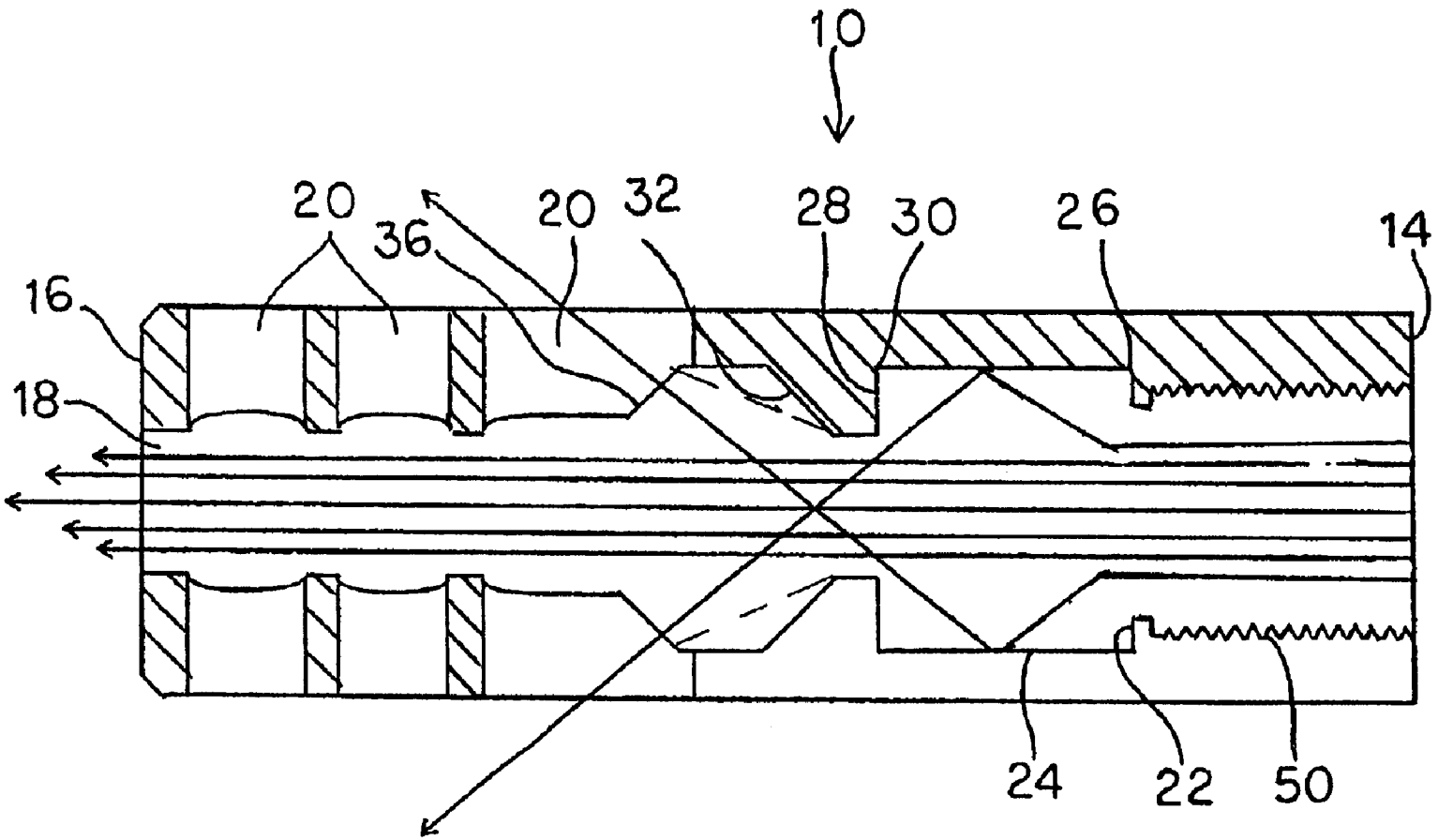
FIG. 3 is the cross-sectional side view shown in FIG. 2, showing the path of travel of gas within the device.

Referring initially to FIGS. 1–3, a first embodiment of the present invention is shown. FIG. 1 shows a perspective view of a first embodiment of the present invention. The invented muzzle brake 10 is made up of a body 10, having an outer surface 12 extending from a first end 14 configured for connection to the muzzle of a firearm (not shown) to a second end 16 along a longitudinal axis L. In this embodiment, the body is generally cylindrical in shape. However, any shape which accomplishes the intended purposes may be used. A central bore 18 having a desired diameter extends through the body 10 along the longitudinal axis L of the cylinder. A series of openings 20 are disposed along the outer surface and extend radially from the central bore 18 to the outer surface 12. The openings 20 are dimensioned so as to have a longitudinal aspect and a lateral aspect, with the longitudinal aspect being greater than the lateral aspect. A variety of shapes may be used to form the openings 20. These include the oval-type shapes and combinations of oval-type shapes shown in FIG. 1, as well as any other shape as long as the longitudinal aspect of the opening is greater than the lateral aspect of the opening. The shape of the body shown is cylindrical to allow for ease in manufacturing and to conform to the customary use of cylindrical shaped muzzle brakes in the art. However, the shape of the body is not limited to a cylinder alone.

An inner chamber (not shown) extends within the body of the muzzle brake from the first end 14 to a desired location within the body of the muzzle brake 10. This inner chamber usually terminates near to the location of an opening 20, and reflects gases towards the openings 20.

Referring now to FIG. 2, shown is a detailed cross-sectional view of the embodiment shown in FIG. 1. Located near the first end 14 of the muzzle brake is a connection means 50 for attaching the invention 10 to the muzzle of a firearm or to another device adapted to connect with this means for connection 50. While in this embodiment the means for connection 50 is a threaded coupling, any means that accomplishes the desired result of attaching the device 10 to a muzzle of a firearm, or an adapter may also be achieved and is contemplated by this invention.

FIG. 2 also shows the inner chamber 22 previously referred to. The inner chamber 22 extends from an inner chamber first end 26 to an inner chamber second end 28 along an inner chamber wall 24. In this embodiment, the inner chamber 22 is a generally longitudinally oriented cylinder. However, any shape or orientation that accomplishes the purpose of reflecting gases outward through the openings 20 may also be used. In this embodiment, the inner chamber 22 has a diameter greater than the diameter of the central bore 18. This provides a location with increased volume where gases can expand. The inner chamber 22 also provides a circumvolving wall 24 which acts as a reflective surface that redirects sound energy and gases out of the muzzle brake 10 through the openings 20. In order to reduce the amount of noise that accompanies the discharge of the firearm, portions of the muzzle brake 10 are adapted, formed and tapered to reduce the incidence of gases against portions of the body 10 of the muzzle brake.

In the embodiment shown in FIG. 2., the second end of the inner chamber 28 has a first side 30 which faces in to the chamber 22 towards the first end of the muzzle brake 14. The second side 32 of the second end 28 of the inner chamber 22 faces the second end 16 of the muzzle brake. In order to prevent contrary reflection of gas and noises back towards the shooter, the second side of the inner chamber's second end 32 is angled and tapered away from the central bore 18 at about a sixty-degree angle. This angle has been found to be most effective for the types of firearms upon which the muzzle brake has been used. However, in other applications the angle may be adjusted according to the specific necessities of the user. FIG. 3 shows two embodiments of the various angles that may be used to achieve the desired results. The tapering of the second side 32 of the second end 28 of the inner chamber creates a frustoconical shape. This shape allows more of the gases to be reflected out of the muzzle brake 10 through the openings 20, and less of the noise and gas to be reflected off of the body of the muzzle brake back towards the shooter.

Referring now to FIG. 3, shown is the same embodiment of the invention shown in FIGS. 1 and 2, with the addition of lines representing the path of travel of gas and sound which accompany a traveling projectile. This figure also shows two different formations of the tapered second side 32 of second end 28.

As a projectile passes through the muzzle brake 10, the gases accompanying and propelling the projectile follow behind the projectile. As these gases travel within the central bore 18; they arrive at the inner chamber 22. Here the increased volume of the inner chamber 22 allows some of the gases to expand. The surfaces of the inner chamber 22, particularly the wall 24, provide a reflective surface which directs impacted gases outward through the openings 20.

The dimensions and location of the inner chamber 22 vary according to the power of the projectile being fired. In as much as projectiles pass through the muzzle brake 10 at various speeds, the accompanying sound waves and gas from the projectile impact the wall 24 of the inner chamber 22 at varying locations and distances. Gases and sound energy from higher powered projectiles generally travel farther than gas and sound energy from lower powered projectiles. Thus, an inner chamber 22 designed for higher powered projectiles requires a greater length between the first end of the muzzle brake 14 and the location of impact with the walls 24 of the inner chamber. In higher powered applications, the length of the inner chamber 22 must be increased so as to allow sufficient distance for the sound waves to impact the walls 24 of the inner chamber 22. The distance, location and design of the openings 30 should be placed so as to allow generally smooth unimpeded passage of the gases and sound outward after reflection off of the walls of the chamber 24.

Upon impacting the chamber walls 24, the angle of reflection should be roughly equal to the angle of incidence upon the wall 24. Thus, the dimensions and proportions of the muzzle brake should be dimensioned so that the location of the point of impact of the sound waves is within the inner chamber 22 and the openings 20 are located away from the point of impact at a distance that maximizes the dispersal of reflected gases out of the muzzle brake. One way that this may be done is by dimensioning the inner chamber 22 to extend approximately one-third the distance of the muzzle brake, and dimensioning the openings 30 so that the openings 30 have a long longitudinal aspect. This enables more of the gas to be radially dispersed and less of the gas to leave the central bore 18 through the second opening behind the projectile. This results in decreased recoil force with only a small increase in noise perceived by the shooter. In experiments performed by the Applicant, the average increase in noise perceived by the shooter was only about two decibels when using the recoil reducing muzzle brake as compared to not using any muzzle brake.

The increased volume of the inner chamber 22 allows a portion of the accumulated hot gases to expand. As these gases expand, sound is produced. The walls of the inner chamber direct the sound and the gases out of the muzzle brake through the openings 20. The openings 20 radially diffuse the gases, thus limiting an accompanying recoil force. The reflective chamber 22 and the length and pattern of the openings 30 allow the sound perceived by the shooter to be reduced by directing the gas and sounds outward away from the muzzle brake 10. The increased length of the openings 20 decreases the amount of gas and sound reflected back toward the shooter that occurs because of gas impinging upon the body of the muzzle brake 10 near the openings 20. The inner chamber 22 also directs and channels sound and gases toward the openings 30. This further reduces the amount of noise that is heard and perceived by the shooter.

The tapered design of the second end surface 38 and the inner surfaces 36 of the device near the openings 20 further encourages and assists the passage of some of the gases out of the muzzle brake. The remaining gases continue to pass through the central bore 18 toward the second end 16 of the muzzle brake 10. As these gases pass through the central bore 18; some of the gas is dissipated out of the muzzle brake through the openings 20. In as much as the gas is moving toward the second end 16 of the muzzle brake 10, the increased longitudinal dimensions of the openings 20 reduce the amount of gases that are reflected backward towards the shooter. As a result of this design, this muzzle brake 10 reduces recoil force felt by a shooter, by dissipating gases, in a manner that does not drastically increase the amount of noise perceived by the shooter.

The placement and dimensions of the internal chamber 22 and the openings 20 are configuired so that the wall 24 of the internal chamber 22 is placed at the point of impact whereby the gases and sound waves are directed off of the wall 24 and outward through the openings 20. As a general rule, the angle of incidence of the sound and gas waves will equal the angle of reflection away from the point of impact. The openings 20 are then designed and located so that the velocity and direction of the gases reflected off of the inner surface will be reflected outward through the openings 20. This combination of an appropriately sized and placed inner chamber 22, together with appropriately dimensioned openings 20, results in a muzzle brake 10 that reduces recoil while increasing the noise from the firearm only a small amount.

In use, a projectile, after being discharged from the muzzle end of the firearm, travels through the central bore 18 of the muzzle brake 10 until exiting the muzzle brake 10 at the second end 16. An accumulation of hot gases and sound energy follow the projectile. As these gases and their accompanying sounds pass through the muzzle brake 10, they are dispersed radially away from the central bore 18 of the device through the openings 20. In other muzzle brakes, these gases would impact against the body of the muzzle brake and reflect noise back towards the shooter. In this invention, however, the amount of noise and gas that impinge and are reflected back towards the shooter is reduced. The inner chamber assists in directing these gases toward the openings 20. The increased longitudinal aspect of the openings 20 facilitates the passage of these gases out of the muzzle brake. This in turn reduces the amount of gas and sound that is reflected off of the muzzle brake back towards the shooter.

The passage of gases, sound and energy is further assisted by the tapering of inner portions 36 of the cylinder, particularly those portions near the openings 20. These tapered surfaces 36 provide a generally smooth surfaces through which the sound producing gases will pass. This reduces the amount of recoil by radially dispersing propellant gases in a way that also reduces the amount gas and noise reflected back towards the shooter.

The dimensions and location of the inner cylinder are determined empirically, depending upon a variety of factors. Generally, higher powered rifles and ammunition require muzzle brakes of longer lengths having longer dimensions such as longer internal chambers 22 and longer openings 20. In addition, the positioning of the internal chamber 22 and the openings 20 may be located further from the muzzle connecting portion of the firearm. The dimensions of each individual muzzle brake 10 will be dependent upon a variety of factors, including the caliber of the gun, the charge being used, the power of the cartridge and other factors related to the power of the projectile.

The exact dimensions of the inner chamber 22 and the distance from the inner chamber 22 to the openings 20 is determined by placing the wall 24 of the inner chamber 22 at a location whereby a desired amount of gas is reflected from the inner chamber 22 outward through the opening 20. In as much as the incidence of the gas against the surface will be reflected at an angle equally dimensioned but oppositely directed, the wall 24 and openings 20 should be placed at locations within the muzzle brake designed to achieve a desired result.

In use, when the firearm is discharged, the projectile passes through the central bore 18 of the muzzle brake 10. The gases propelling the projectile are reflected and directed by the walls of the inner chamber and exit the muzzle brake 10 though the openings 20 and are dispersed away from the longitudinal axis L of the muzzle brake 10. The directing and reflecting of gases through the long openings 30 results in less gas and noise being reflected back towards the shooter. This correlates to a reduction in noise perceived by the shooter upon discharge of the firearm. While in this embodiment the shape of the muzzle brake and the inner chamber are generally cylindrical, it is to be distinctly understood that any shape or configuration may be used for the muzzle brake, inner chamber, openings, or central bore.

Figure 4:
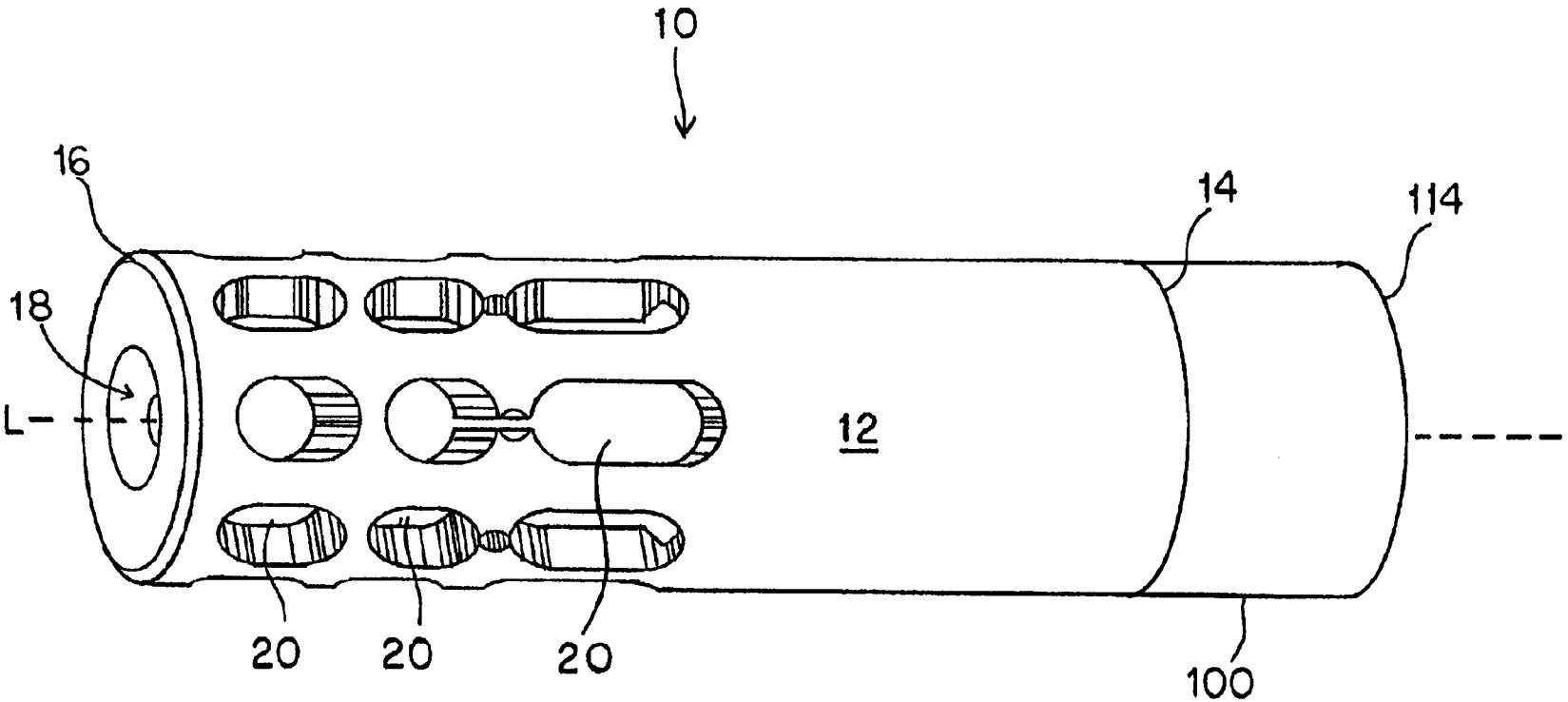
FIG. 4 is a perspective view of a second embodiment of the present invention
Figure 5:
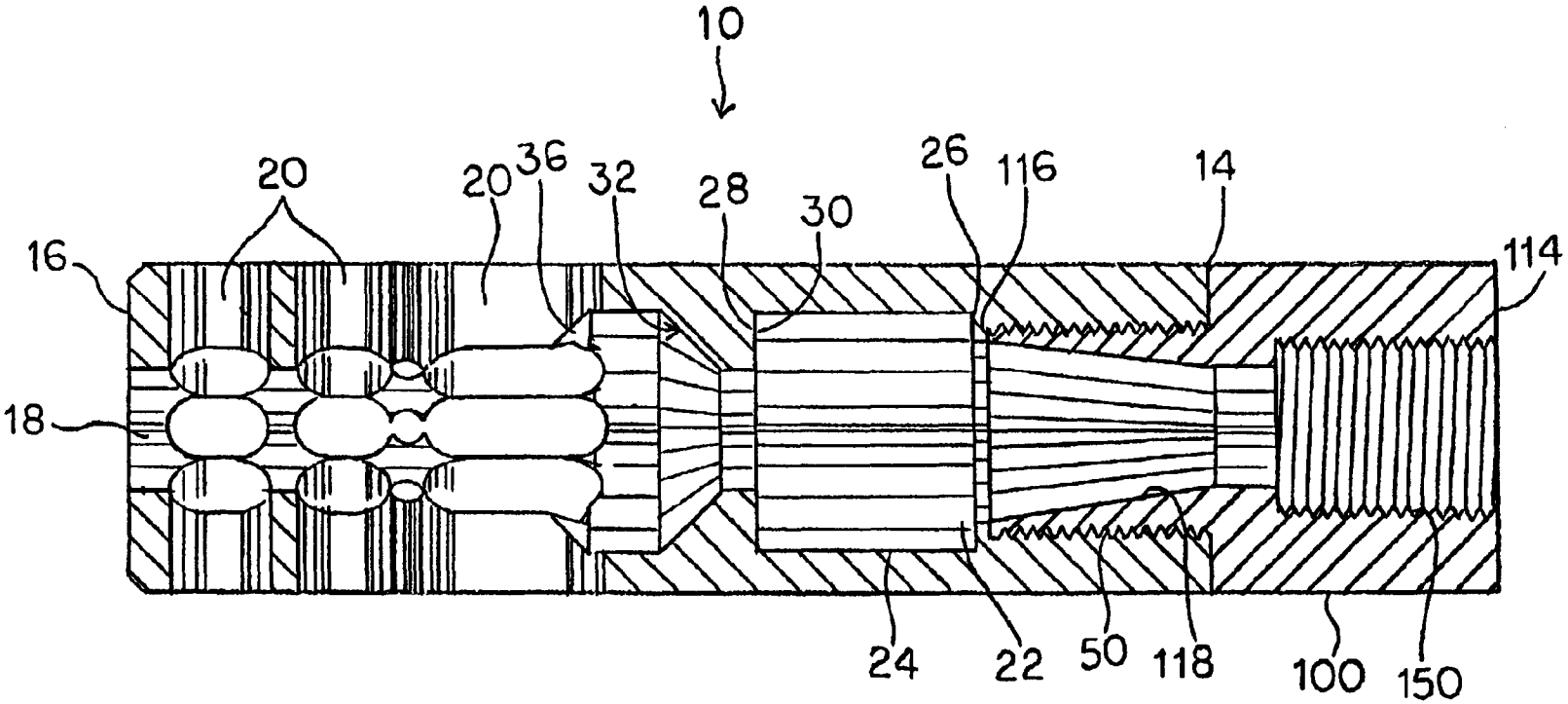
FIG. 5 is cross-sectional side view of a second embodiment of the present invention
Figure 6:
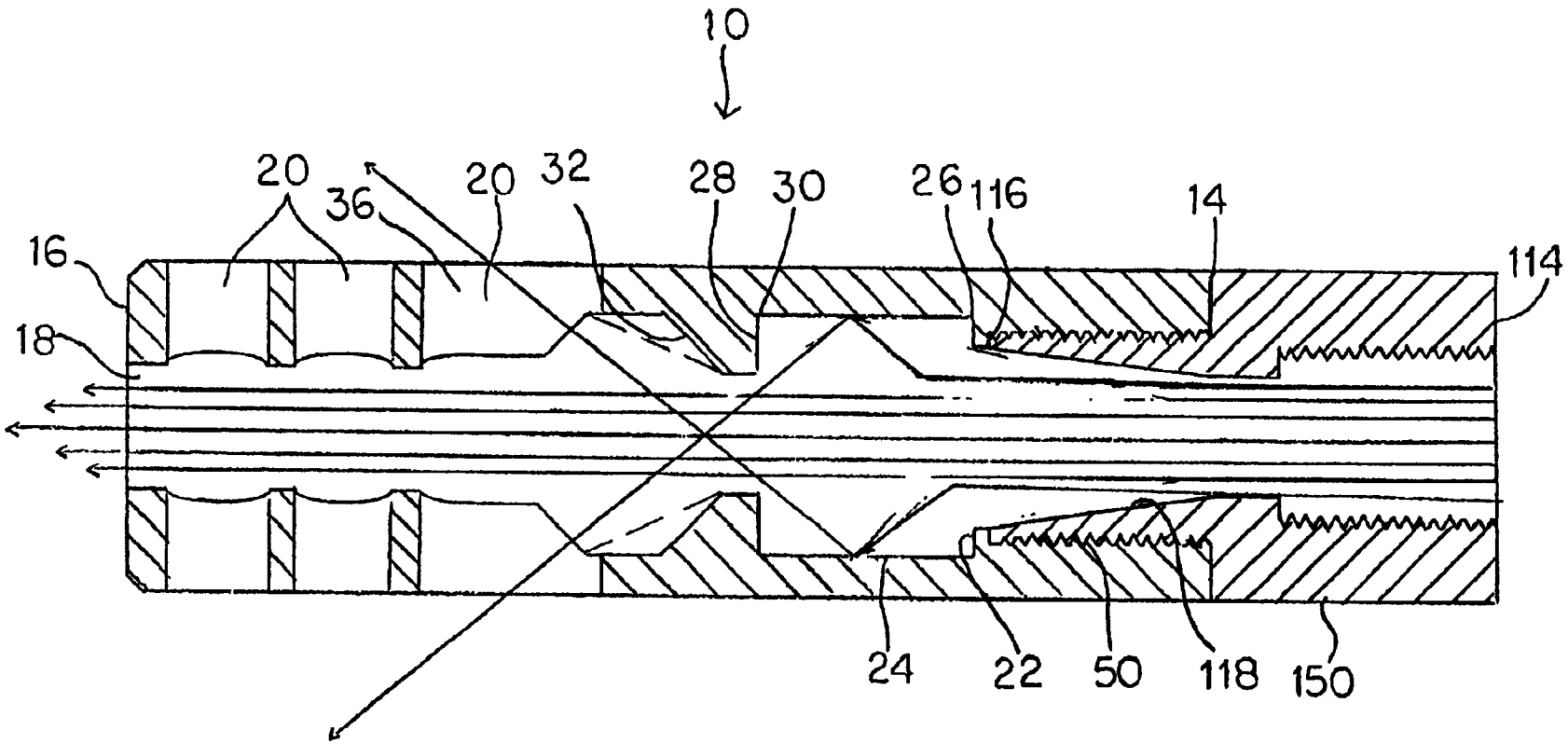
FIG. 6 is a cross-sectional side view of the second embodiment shown in FIG. 5, showing the path of travel of gas within the device.

FIGS. 4–6 show the same muzzle brake 10 in a second preferred embodiment of the present invention, including a first end attachment adapter 100. This front-end attachment adapter 100 elongates the distance between the end of the firearm and the second end of the muzzle brake 16. In addition to extending the length, the front-end attachment adapter provides a connection between the muzzle brake 10 and various types and sizes of connecting means.

FIG. 4 shows a perspective view of the muzzle brake 10 with the first-end attachment adapter 100 attached. The first end of the attachment adapter 114 is configured for attachment to the muzzle end of a firearm. The second end of the attachment adapter (not shown) is adapted for connection with the first end of a muzzle brake 14.

FIG. 5 shows a detailed cross-sectional view of the second preferred embodiment wherein the first-end attachment adapter 100 is connected to the muzzle brake 10. The first-end adapter 100 has a first end 114 extending to a second end 116 along a generally longitudinal axis. The first-end adapter 100 has a means 150 configuired for attachment to a muzzle end of a firearm. While in this embodiment a threaded means is shown, it is to be distinctly understood that any means which accomplishes the purpose of attaching a muzzle brake to a firearm may be used and is contemplated by this invention.

A central bore 118 extends through the body of the adapter from the first end 114 to a the second 116 along the same longitudinal axis. This central bore 118 has a diameter and is configuired to correspond and connect with the central bore 18 of the muzzle brake 10. The second end of the adapter 116 is configuired to connect with the first end attachment means 50 of the muzzle brake 10. While in this embodiment the connection between the first end of the muzzle brake 14 and second end of the adapter 116 is made by correspondingly configuired threaded surfaces, it is to be distinctly understood that this is only one method for connection. Any method of connection that provides a connection sufficient for the purposes of the invention may be used, and is contemplated by this invention.

When the attachment adapter 100 is placed between the muzzle of the firearm and the muzzle brake 10, the distance that a projectile and its attendant gases must travel before leaving the second end 16 of the projectile is increased. This additional length allows for additional expansion of the gases and further reduces the amount of noise occasioned by the firearm upon discharge. In addition, the adapter allows the muzzle brake 10 to be used with firearms that do not have a corresponding adapted means for attaching with the first-end attachment means 50 of the muzzle brake 10. In addition to the increased length added by the adapter 100, the bore of the adapter 118 is outwardly tapered to expand as it progresses towards the inner chamber 22 of the muzzle brake 10. This tapered dimension allows additional gas expansion prior to the inner chamber 22. This enables more of the gas to be directed smoothly outward through the openings 20 and reduces the amount of gas reflected back towards the shooter. This allows gas and sound to be passed more easily out of the muzzle brake 10 with less of the sound and gas being reflected back towards the shooter. This results in a muzzle brake that reduces recoil in a manner that only increases the amount of noise perceived by the shooter a small amount.

FIG. 6 shows the same embodiment shown in FIG. 5 with the inclusion of lines representing the path of travel of gases through the muzzle brake. This figure also shows the two tapering angles of second side 32 that may be used.

While there is shown and described the present preferred embodiment of the invention, it is to be distinctly understood that this invention is not limited thereto but may be variously embodied to practice within the scope of the following claims. From the foregoing description, it will be apparent that various changes may be made without departing from the spirit and scope of the invention as defined by the following claims.

What is claimed is:

1. A muzzle brake configured for attachment to a firearm muzzle, said muzzle brake configured to dissipate recoil force producing gasses away from the location of a shooter, said muzzle brake comprising:

a body having a first end adapted for attachment to a muzzle, an outer surface extending from said first end to a second end along a generally longitudinal axis, a central bore configured to allow passage of a projectile from said first end to said second end along said generally longitudinal axis, said body defining at least three elongated first openings and a plurality of secondary radial gas holes, said secondary radial gas holes located within said body distal from said first end, each of said radial gas holes having a perimeter and extending radially from said central bore to said outer surface said elongated openings positioned nearest to said first end as compared to any other aperture defined within said outer surface of said muzzle brake, each of said elongated openings having a longitudinal dimension and a lateral dimension, said longitudinal dimension being greater than said lateral dimension, said elongated openings having a greater longitudinal dimension than any other aperture defined within said muzzle brake, said elongated openings configured to connect said central bore to said outer surface and to facilitate the passage of gasses propelling a projectile away from said first end of said muzzle brake, said body further defining an inner chamber connected to said central bore, said inner chamber having a larger diameter than the diameter of said central bore and configured to direct incident gases out of said muzzle brake through said first elongated openings.

2. The muzzle brake of claim 1 wherein said radial gas holes are generally linearly disposed along said longitudinal axis of said body.

3. The muzzle brake of claim 1 wherein said elongated openings are comprised of a first radial gas hole defined within said body, said first radial gas hole having a first radial gas hole perimeter, and extending from said central bore to said outer surface, said first radial gas hole connected to a second radial gas hole defined within said body, said second radial gas hole having a second radial gas hole perimeter, and extending radially from said central bore to said outer surface, said first radial gas hole perimeter configured to overlap said second gas hole perimeter.

4. The muzzle brake of claim 1 wherein said elongated openings are comprised of a first radial gas hole defined within said body, said first radial gas hole having a first radial gas hole perimeter, and extending from said central bore to said outer surface, said first radial gas hole positioned proximate to a second radial gas hole defined within said body, said second radial gas hole having a second radial gas hole perimeter, and extending from said central bore to said outer surface, said second radial gas hole positioned proximate to a third gas hole defined within said body, said third gas bole having a third gas hole perimeter and extending from said central bore to said outer surface, said first radial gas hole perimeter configured to overlap said second gas hole perimeter, and said second gas hole perimeter configured to overlap said first gas hole perimeter and said third gas hole perimeter.

5. The muzzle brake of claim 1 wherein said inner chamber has at least one wall, said wall configured to reflect an amount of gas through said opening.

6. The muzzle brake of claim 1 wherein an inner portion of said body is tapered near said first elongated openings to facilitate passage of gases out of said muzzle brake.

7. A muzzle brake configured for use with a firearm having a muzzle, said muzzle brake configured for reducing recoil while discharging said firearm, said muzzle brake comprising:

a cylinder having a first end adapted for attachment to a firearm, an outer surface extending from said first end to a second end along a longitudinal axis, a central bore configured to allow passage of a projectile through said cylinder, said outer surface defining at least three elongated first openings, and a plurality of secondary radial gas holes said elongated first openings positioned nearest to said first end as compared to any other aperture defined within said outer surface of said muzzle brake, said elongated first openings positioned circumvolving around said outer surface near said first end, said first openings configured to have a longitudinal dimension and a lateral dimension, said longitudinal dimension being greater than said lateral dimension, said first openings having a greater longitudinal dimension than the longitudinal dimension of any other opening defined within said cylinder, said first openings further configured to extend from said central bore to said outer surface, said first elongated openings configured to direct discharge of propellant gasses away from said first end of said muzzle brake;

a plurality of radial gas holes, said radial gas holes located proximate to said first openings and distal from said first end, said first end configured for attachment to the muzzle of a firearm; said central bore having a desired diameter and extending through the cylinder along said longitudinal axis; said radial gas holes linearly disposed along the longitudinal axis of the cylinder, each gas hole having a perimeter and a diameter smaller than said central bore, and extending radially from said central bore to said outer surface; and an inner chamber defined within said cylinder, said inner chamber connected to said central bore, said inner chamber having a larger diameter than the diameter of said central bore; said inner chamber further configured to reflect incident gases out of said muzzle brake through said first elongated openings.

8. The muzzle brake of claim 7 wherein said opening is a first radial gas hole defined within said cylinder having a first radial gas hole perimeter, and extending from said central bore to said outer surface connected to a first channel defined within said outer surface, said first channel also connected to a second radial gas hole defined within said cylinder having a second radial gas hole perimeter, and extending radially from said central bore to said outer surface; said second radial gas hole being connected to a second channel, defined within said outer surface, said second channel also connected to a third gas hole defined within said cylinder having a third gas hole perimeter and extending from said central bore to said outer surface.

9. The muzzle brake of claim 7 wherein each of said first openings are formed by a first radial gas hole defined within said cylinder, said first radial gas hole having a first radial gas hole perimeter, and extending from said central bore to said outer surface, said first radial gas hole connected to a second radial gas hole defined within said cylinder said second radial gas hole having a second radial gas hole perimeter, and extending radially from said central bore to said outer surface cylinder, said first radial gas hole perimeter configured to overlap said second gas hole perimeter.

* * * * *